United States Patent [19]

Tripp

[11] Patent Number: 4,807,878

[45] Date of Patent: Feb. 28, 1989

[54] SPINNER TRIVIA GAME

[76] Inventor: Gregory A. Tripp, HQ's USA EUR (ODCSI) P.O. Box 1861, Apo New York, N.Y. 09063

[21] Appl. No.: 105,568

[22] Filed: Oct. 8, 1987

[51] Int. Cl.[4] ..... A63F 3/00

[52] U.S. Cl. ..... 278/1 E; 273/DIG. 26; 273/237

[58] Field of Search ..... 273/236, 249, 243, 257, 273/236, 249, 243, 237, 1 E, DIG. 26

[56] References Cited

U.S. PATENT DOCUMENTS

| | | | |
|---|---|---|---|
| 1,210,614 | 1/1917 | Dorer | 273/249 |
| 4,557,485 | 12/1985 | Lordon | 273/249 |
| 4,625,970 | 12/1986 | Childs et al. | 273/257 |
| 4,714,255 | 12/1987 | Henry et al. | 273/249 |

*Primary Examiner*—Richard C. Pinkham
*Assistant Examiner*—Benjamin Layno
*Attorney, Agent, or Firm*—Jerry T. Kearns

[57] ABSTRACT

A trivia game utilizes a game board provided with four spinners. The first spinner determines which player is to answer the question, the second spinner determined the challenging player, the third spinner determines the category of the question and the fourth spinner determines the point value and degree of difficulty of the question. The game board may also be provided with a timer for regulating the length of play and a plurality of counters for keeping score. The game utilizes eight different sets of cards, with each set of cards having questions and answers from a certain subject category imprinted thereon. Each of these eight stacks of cards is placed on a designated location on the game board. Four different types of special cards are shuffled into each of the eight stacks of subject category cards. These special cards include no risk challenge cards, gang up cards, free points cards and erase challenge cards. The game may be played for amusement purposes, utilizing various trivia type subject categories, or may be utilized as an educational device with specially prepared subject cards.

15 Claims, 3 Drawing Sheets

SPINNER TRIVIA GAME

BACKGROUND OF THE INVENTION

1. Field of the Invention

The present invention relates to trivia games and chance spinner games, and more particularly pertains to a new and improved spinner trivia game. The conventional trivia game utilizes various subject category cards imprinted with questions and answers. However, this type of game does not provide a random chance element to add excitement to the game, as well as to allow players of lesser ability a chance to win the game. Also, the conventional trivia game does not provide a game board with facilities for organizing the subject category cards and counters for keeping track of each player's score. Further, the conventional trivia game is relatively slow paced, and may become monotonous. In order to overcome these disadvantages of the conventional type of trivia game, the present invention provides a trivia game board with four random chance spinners, a timer and a plurality of counters for keeping track of each player's score.

2. Description of the Prior Art

Various types of spinner games are known in the prior art. A typical example of such a spinner game is to be found in U.S. Pat. No. Des. 132,130, which issued to A. Melton et al on Apr. 21, 1942. This patent discloses a game board provided with four numbered spinners. U.S. Pat. No. Des. 149,336, which issued to S. Binder on Apr. 20, 1948, discloses a game board provided with several spinners and parallel race track courses. U.S. Pat. No. Des. 173,465, which issued to W. Taylor on Nov. 9, 1954, discloses a game board provided with concentric circular race tracks and a central spinner. U.S. Pat. No. Des. 252,344, which issued to W. Parker et al on July 10, 1979, discloses a biblical game board with a central circular spinner. U.S. Pat. No. 1,699,132, which issued to D. Buchanan on Jan. 15, 1929, discloses a movie game board which is provided with a numbered spinner. The game board includes a series of columns containing corresponding structural divisions of essential elements of several stories, with each column being divided transversely into spaces for containing the individual elements. By utilizing the spinner to select a space from each column at random, a complete story may be woven from the randomly selected elements.

While the above mentioned devices are suited for their intended usage, none of these devices provides a trivia game which utilizes four spinners for randomly selecting the player to answer a question, the challenging player, the subject category of the question and the degree of difficulty and point value of the question. An additional feature of the present invention, not disclosed by he aforesaid game devices, is the provision of special cards to be interspersed among subject category question cards. Still another novel feature of the present invention is the provision of a game board provided with four random selection spinners, a timer for regulating the length of play of a trivia game and a plurality of counters for maintaining each player's score. Inasmuch as the art is relatively crowded with respect to these various types of spinner games, it can be appreciated that there is a continuing need for and interest in improvements to such spinner games, and in this respect, the present invention addresses this need and interest.

SUMMARY OF THE INVENTION in view of the foregoing disadvantages inherent in the known types of trivia games and spinner games now present in the prior art, the present invention provides an improved spinner trivia game. As such, the general purpose of the present invention, which will be described subsequently in greater detail, is to provide a new and improved spinner trivia game which has all the advantages of the prior art spinner and trivia games and none of the disadvantages.

To attain this, representative embodiments of the concepts of the present invention are illustrated in the drawings and make use of a generally rectangular housing provided with four spinners disposed at each corner portion of an upper face thereof. A plurality of counters are also disposed on the upper face of the housing for keeping track of each player's score. An electrically operated timing device is centrally disposed on the upper face and a reset button for the timing device is disposed adjacent thereto. A plurality of positions are designated on the upper face for locating corresponding stacks of subject category question cards. Received within the interior of the housing are the rotatable mountings for the each of the spinners, the counter mechanisms and the timer operating mechanism. The present invention contemplates the use of eight subject category question cards, with one hundred cards in each category. Additionally, four types of special cards are provided to be interspersed randomly within each stack of subject category cards. These special cards include no risk challenge cards, gang up cards, free point cards and erase challenge cards. One of the spinners is utilized to select the subject category, one to select the point value and degree of difficulty of the question, one to select the player to answer the question and the fourth spinner is utilized to select the challenging player. Thus, it may now be understood that the provision of the four different types of special cards and the four random chance spinners add an element of luck to the play of the game. This permits players of lesser abilities to have a chance to win the game.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved spinner trivia game which has all the advantages of the prior art trivia and spinner games and none of the disadvantages.

It is another object of the present invention to provide a new and improved spinner trivia game which may be easily and efficiently manufactured and marketed.

It is a further object of the present invention to provide a new and improved spinner trivia game which is of a durable and reliable construction.

An even further object of the present invention is to provide a new and improved spinner trivia game which is susceptible of a low cost of manufacture with regard to both materials and labor, and which accordingly is then susceptible of low prices of sale to the consuming public, thereby making such spinner trivia games economically available to the buying public.

Still yet another object of the present invention is to provide a new and improved spinner trivia game which provides in the apparatuses and methods of the prior art some of the advantages thereof, while simultaneously overcoming some of the disadvantages normally associated therewith.

Still another object of the present invention is to provide a new and improved spinner trivia game which provides an element of chance in a trivia game format.

Yet another object of the present invention is to provide a new and improved spinner trivia game which utilizes a game board provided with four random chance spinners and counters for keeping track of each player's score.

Even still another object of the present invention is to provide a new and improved spinner trivia game which utilizes a plurality of different subject category question cards and four different types of special cards which add an element of chance to the play of the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
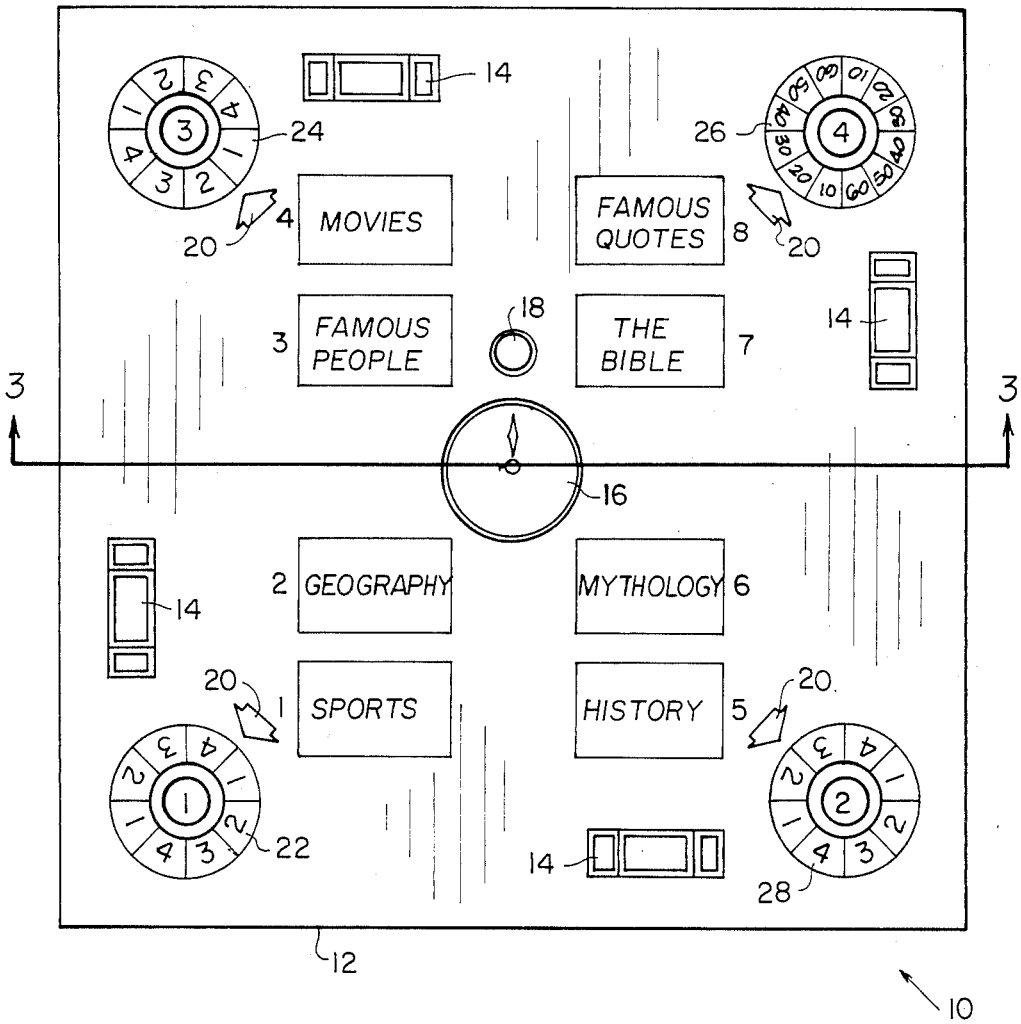
FIG. 1 is a plan view of the spinner trivia game board of the present invention.

With reference now to the drawings, and in particular to FIG. 1 thereof, a new and improved spinner trivia game embodying the principles and concepts of the present invention and generally designated by the reference numeral 10 will be described.

More specifically, it will be noted that the first embodiment 10 of the invention includes a hollow, generally rectangular housing 12. A plurality of digital counters 14 are spaced around the four sides of the top surface of the housing 12. The top surface of the housing forms the game board. An electrically operated timing device 16 is disposed centrally on the top surface of the housing 12. A reset button 18 for the timing device 16 is disposed adjacent thereto. A plurality of indicating pointers 20 are affixed to the upper surface of the housing 12. Each of the indicating pointers 20 is positioned adjacent a spinner disposed at each of the four corner portions of the top surface of the housing 12. A first spinner 28 is designated by an imprinted numeral one and has a circular dial numbered with the numerals one through four. This first spinner 28 is utilized to select the player who will answer the next question. A second spinner 22, numbered two, has a circular dial printed with the numerals one through eight. This spinner is utilized to randomly select the subject category of the next question to be answered. A third spinner 24 is designated by the numeral three and has a circular dial printed with the numerals one through four. This spinner is utilized to randomly select the player who will be the challenger. The fourth spinner 26 is designated by the numeral four and is imprinted with the numbers ten, twenty, thirty, forty, fifty and sixty. This spinner is utilized to select the degree of difficulty and corresponding point value of the next question to be asked. Various subject category cards, for example movies, famous people, geography, sports, famous quotes, the Bible, mythology and history, are placed in stacks in designated locations on the top face of the housing 12.

Figure 2:
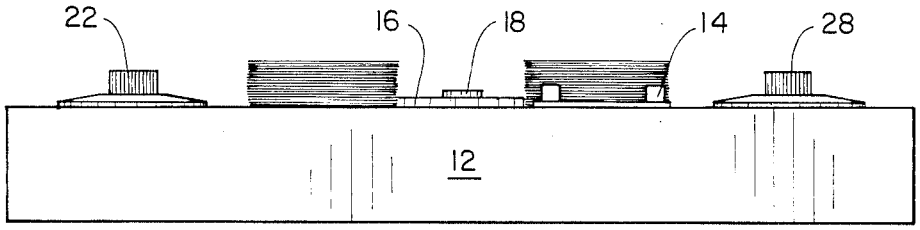
FIG. 2 is a side elevational view of the spinner trivia game board of the present invention.

In the side view of the housing 12, depicted in FIG. 2, it may be seen that the spinners, cards, timer and counters extend above the top surface of the housing 12.

Figure 3:
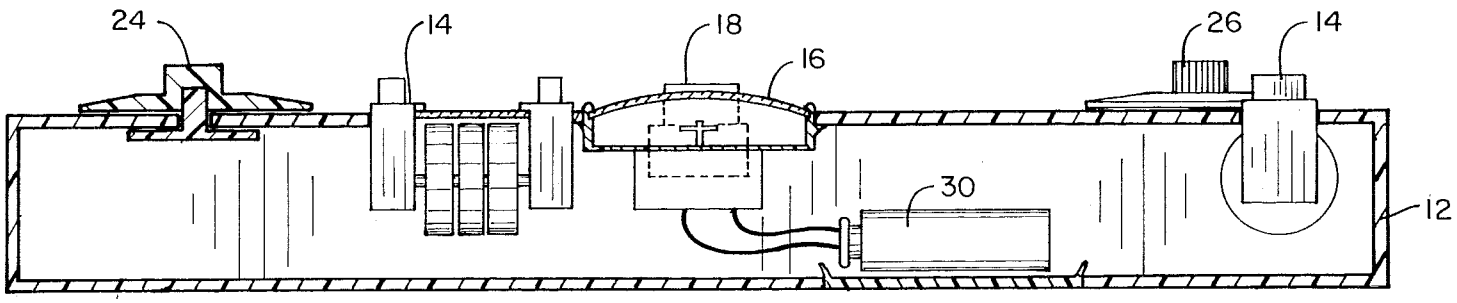
FIG. 3 is a cross sectional view taken along line 3—3 of FIG. 1, illustrating the internal mechanisms of the game board of the present invention.

With reference now to FIG. 3, it may be seen that the spinner 24 is mounted for rotation on a shaft which extends through a hole in the top surface of the housing 12. The internal mechanisms of the counters 14 are disposed within the interior of the housing 12. These counters 14 are conventional mechanical digital wheel counters, each provided with an increment button and a reset button. The timer 16 extends through a circular central aperture in the top surface of the housing 12. The mechanism of the timer 16 is disposed within the interior of the housing 12, as is a battery 30 for powering the timer 16.

Figure 4:
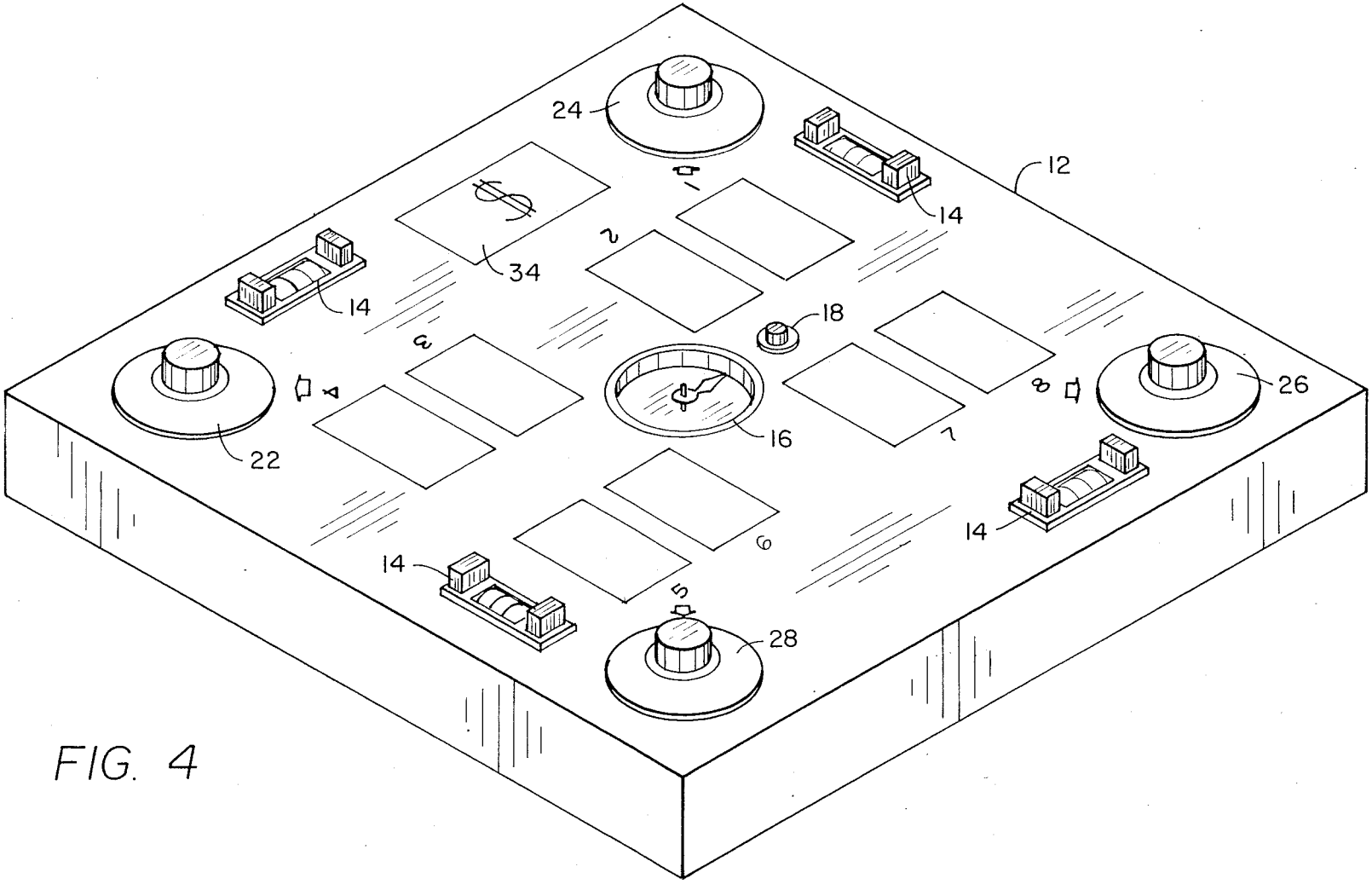
FIG. 4 is a perspective view of the spinner trivia game board of the present invention.

With reference now to FIG. 4, it may be seen that a designated location is provided for each of the eight subject category question cards. A stack of play money 34 may be used in a variation of play of the spinner trivia game of the present invention.

The spinner trivia game board of the present invention may also be constructed as a simple folding cardboard game board provided with four rotatably mounted spinners, counters and designated locations for the placement of the subject category cards. In this form, the timer would be omitted to keep the cost of the game board as low as possible.

With reference now to FIG. 1, the manner of play of the game of the present invention will now be described. Each of the eight categories of subject question cards includes one hundred cards. Each of these question cards is printed with various questions in the relevant subject category. Each card has a series of six questions and answers of various degrees of difficulty printed thereon. Four different types of special cards are also utilized in the play of the game. A first type of card is printed with the words "NO RISK CHALLENGE". A second type of card is imprinted with the words "GANG UP CARD". A third type of card is imprinted with the words "FREE POINTS" and the fourth type of special card is imprinted with the words "ERASE CHALLENGE". Into each stack of one hundred subject category question cards, five "NO RISK CHALLENGE" cards, two "GANG UP" cards, two "FREE POINTS" cards and one "ERASE CHALLENGE" card are added. Each stack of cards is then shuffled and placed on a designated location on the top surface of the housing 12. To start play, each of the spinners one through four are spun sequentially or in unison. The player number selected by the indicating pointer 20 adjacent spinner 28 is the player who will answer the first question. The player indicated by the pointer 20 adjacent the spinner 24 is the challenging player. The subject category is determined by indicating pointer 20 adjacent spinner 22. And the degree of difficulty of the question to be asked is determined by pointer 20 adjacent spinner 26. When the player to answer the question and the challenging player have been selected, one of the remaining players draws the top card of the selected subject category and asks the question of the indicated degree of difficulty. If the selected player is able to correctly answer the question, he will be awarded the corresponding point value, depending on the degree of difficulty of the question. These points are then added to the player's total on their counter 14. If the question is answered incorrectly the player receives zero points. As an alternative to answering the question, the player may direct the question to the challenger indicated by the spinner 24. If the player elects this course of action, the challenging player will then attempt to answer the question. If the challenger correctly answers the question he will receive double the original point value of the question and the person who challenged would lose the original point value. The player who opted to direct the question to the challenger would also receive their first challenge loss. If the challenger failed to answer the question correctly, he would lose the original point value of the question and the first player would receive twice the original point value. In this case the challenger would not receive a challenge loss because he was not the one that challenged. If any one player loses ten challenges in a game, he is automatically discharged from the game, but would remain to operate one of the spinners. If the card drawn is a "NO RISK CHALLENGE" card, the player who is indicated to answer the question will receive possession of the card. This card will enable a player to challenge, but if he loses the challenge he does not lose points or receive a challenge loss. The player may select when the card is to be utilized. This card is only good once, and upon use will be returned to the bottom of the pile. If a "GANG UP" card is selected, the player designated as the one to answer the question may utilize the card to remove fifty points off the score of the player of his choice. This card must be used at once and then returned to the bottom of the pile. If a "FREE POINTS" card is drawn the player designated as the player to answer the question automatically wins the point total on spinner 26. This card must also then be immediately returned to the bottom of the pile. If an "ERASE CHALLENGE" card is drawn the player drawing the card will then reset his challenge counter to zero and then return the card to the bottom of the pile. Play continues in this fashion until one player reaches three hundred points. Any player accumulating ten challenge losses is automatically discharged from the game. In a variation of the play, play money may be utilized, with each player receiving one thousand dollars at the beginning of the game. At the end of a preset time limit, the player with the most remaining money would win. The timer 16 may be utilized to regulate this time limit, or may be operated to limit the amount of time allowed a player to answer a question.

The subject category question cards may be selected from various general categories or may be specially formulated for preselected subjects, to enable the game to be utilized as an educational tool. At this point, it will be obvious to those of ordinary skill in the art, that the number of players may be increased by adding additional numerals to spinners 24 and 28 and providing additional counters 14. In the embodiment illustrated above, the game is preferably played with four players. This allows each player to be in charge of operation of one of the four spinners.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is no desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved spinner trivia game, comprising:

game board means;

first rotatably mounted spinner means on said game board means for selecting a player designation number to answer a question;

second rotatably mounted spinner means on said game board means for selecting a numerically designated location;

third rotatably mounted spinner means on said game board means for selecting a challenge player designation number;

fourth rotatably mounted spinner means on said game board means for selecting a degree of question difficulty a plurality of numerically designated location means on said game board means; and a plurality of stacks of subject category question cards each stack being a different subject category, each card imprinted with questions and answers of varying degrees of difficulty, received on said location means.

2. The spinner trivia game of claim 1, further comprising a plurality of counter means on said game board means for keeping track of player scores.

3. The spinner trivia game of claim 1, further comprising timing means centrally mounted on said game board means.

4. The spinner trivia game of claim 3, wherein said timing means includes reset means mounted on said game board means.

5. The spinner trivia game of claim 1, further comprising a plurality of "NO RISK CHALLENGE" cards associated with each stack of subject category question cards.

6. The spinner trivia game of claim 1, further comprising a plurality of "GANG UP" cards associated with each stack of subject category question cards.

7. The spinner trivia game of claim 1, further comprising a plurality of "FREE POINTS" cards associated with each stack of subject category question cards.

8. The spinner trivia game of claim 1, further comprising at least one "ERASE CHALLENGE" card associated with each stack of subject category question cards.

9. The spinner trivia game of claim 1, wherein said subject category question cards comprise eight different subject categories, including movies, famous people, geography, sports, famous quotes, the bible, mythology and history.

10. The spinner trivia game of claim 9, wherein each subject category includes one hundred question cards.

11. The spinner trivia game of claim 10, wherein each subject category question card is printed with six questions and answers of varying degrees of difficulty.

12. The spinner trivia game of claim 1, wherein said game board means comprises a hollow generally rectangular housing.

13. The spinner trivia game of claim 12, wherein each of said spinner means comprises a circular dial having a shaft received for rotation through an aperture in a top face of said game board means.

14. The spinner trivia game of claim 12, wherein a plurality of counter means and a timing means are mounted on said game board means, operating mechanisms of said counter means and said timing means are received within the interior of said hollow rectangular housing.

15. A new and improved spinner trivia game, comprising:

a hollow generally rectangular housing;

a top face of said housing forming a game board;

four rotatable spinners mounted in corner portions of said game board;

a first of said spinners being printed with player designating numbers for selecting a player to answer question;

a second of said spinners being printed with category numbers for selecting a numerically designated location;

a third of said spinners being printed with player designation numbers for selecting a challenging player;

a fourth of said spinners being printed with degrees of question difficulty for determining a degree of difficulty of a question to be asked;

a plurality of numbered locations on said game board for receiving subject category question cards;

a plurality of different stacks of subject category question cards received on said designated locations;

four manually actuated counters mounted at side portions of said game board;

a timer centrally mounted on said game board;

a timer reset button mounted on said game board adjacent said timer;

a plurality of "NO RISK CHALLENGE" cards associated with each stack of subject category question cards;

a plurality of "GANG UP" cards associated with each stack of subject category question cards;

a plurality of "FREE POINTS" cards associated with each stack of subject category question cards; and at least one "ERASE CHALLENGE" card associated with each stack of subject category question cards.

* * * * *